US006898381B2

(12) United States Patent
Maebashi et al.

(10) Patent No.: US 6,898,381 B2
(45) Date of Patent: May 24, 2005

(54) COLOR IMAGE FORMING APPARATUS AND METHOD FOR CONTROLLING THE SAME

(75) Inventors: Yoichiro Maebashi, Tokyo (JP); Tomoaki Nakai, Shizuoka (JP); Hiroki Tezuka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/286,775

(22) Filed: Nov. 4, 2002

(65) Prior Publication Data

US 2003/0091357 A1 May 15, 2003

(30) Foreign Application Priority Data

Nov. 9, 2001 (JP) ..... 2001/344831
Nov. 9, 2001 (JP) ..... 2001/344832

(51) Int. Cl.[7] ..... G03G 15/00
(52) U.S. Cl. ..... 399/15; 399/49
(58) Field of Search ..... 399/49, 15, 39, 399/40, 41, 72; 358/504, 406, 518, 523, 296; 347/115

(56) References Cited

U.S. PATENT DOCUMENTS 6,029,021 A 2/2000 Nishimura et al. ..... 399/49

*Primary Examiner*—Sophia S. Chen
(74) *Attorney, Agent, or Firm*—Fitzpatrick, Cella, Harper & Scinto

(57) ABSTRACT

A color image forming apparatus includes a first density detecting unit for detecting a density of a first detection toner image formed on an image bearing member or a transferring material carrying member, and a second density detecting unit for detecting a density of a second detection toner image fixed onto a transferring material, and executes image density control based on a detection result of the first density detecting unit and a detection result of the second density detecting unit. A detecting light application position of the first density detecting unit and a detection light application position of the second density detecting unit are almost equal relative to a perpendicular direction to a transferring material conveying direction. It is thereby possible to shorten time required for density control and to prevent deterioration of density control accuracy caused by a temporal change and a positional change in the density of a detection toner patch.

14 Claims, 12 Drawing Sheets

COLOR IMAGE FORMING APPARATUS AND METHOD FOR CONTROLLING THE SAME

BACKGROUND OF THE INVENTION

1. Field of the Invention

The present invention relates to a color image forming apparatus such as a color printer or a color copier.

2. Description of the Related Art

In recent years, a color image forming apparatus such as a color printer or a color copier which employs an electrophotographic method, an ink-jet method or the like, is required to improve the image quality of an output image. The density gradation and stability thereof, in particular, greatly influence a user's judgment as to whether an image is good or bad.

However, if the constituent elements of the color image forming apparatus change according to an environmental change or due to use over a long time, the density of the output image changes. In a color image forming apparatus which employs an electrophotographic method, in particular, density changes and color balance is disturbed even if the environment only slightly changes. Due to this, it is necessary to provide means for always maintaining image density constant To this end, the color image forming apparatus is constituted to obtain stable images by forming a density detection toner image (to be referred to as a "patch" hereinafter) on an intermediate transferring body, a photosensitive member or the like, detecting the density of an unfixed toner patch using an unfixed toner density detection sensor (to be referred to as "density sensor" hereinafter), feeding back process conditions including exposure quantity and developing bias based on the detection result, and thereby controlling the image density.

The density control using the density sensor is, however, intended to detect image density by forming a patch on an intermediate transferring body, drum or the like and not to control a change in the color balance of the image caused by the transfer and fixing of the patch onto the transferring material. Thus, the density control using the density sensor cannot deal with this latter change.

To deal with this change, therefore, a color image forming apparatus provided with a sensor which detects the density or color of a patch on a transferring material (which sensor will be referred to as a "color sensor" hereinafter) is considered.

This color sensor is constituted so that three or more types of light sources such as red (R), green (G) and blue (B) different in emission spectrum are used as light emitting elements, or a light source which emits white color (W) is used as a light emitting element, and three or more types of filters, such as red (R), green (G) and blue (B) filters, different in spectral transmittance are formed on the light receiving elements. By so constituting, it is possible to obtain three or more different types of outputs such as RGB outputs.

To control color density using the color sensor, however, it is required to form a patch on a transferring material, thus consuming the transferring material and toners. It is, therefore, impossible greatly to increase the frequency with which control is performed. Accordingly, it is necessary effectively to control density while minimizing control executing frequency using the color sensor.

SUMMARY OF THE INVENTION

It is under these circumstances that the present invention has been made. It is, therefore, an object of the present invention to provide a color image forming apparatus which can decrease frequency with which density control density is performed using a color sensor by means of combination of a color sensor and a density sensor, thereby to suppress the consumption of a transferring material, and which can exhibit superior color stability to that obtained by conventional density control only using a density sensor.

According to one aspect of the present invention is provided a color image forming apparatus comprising first density detecting means for detecting a density of an unfixed toner image formed on an image bearing member or a transferring material carrying member; and second density detecting means for detecting a density of a fixed toner image formed on a transferring material, in which the first density detecting means is corrected based on a detection result of the second density detecting means.

According to another aspect of the present invention is provided an image density control method for a color image forming apparatus comprising: first density detecting means for detecting a density of an unfixed toner image formed on an image bearing member or a transferring material carrying member; and second density detecting means for detecting a density of a fixed toner image formed on a transferring material, the method is comprising the steps of correcting the first density detecting means based on a detection result of the second density detecting means, correcting the first density detecting means using a value obtained by detecting a monochromatic toner image of black by the second density detecting means for a black toner, and detecting a mixed color toner image of three colors of cyan, magenta and yellow and the monochromatic toner image of black by the second density detecting means for cyan, magenta and yellow toners, comparing a detection result of the mixed color toner image with a detection result of the monochromatic toner image of black, and forming a correction table for the first density detecting means in accordance with a comparison result.

According to yet another aspect of the present invention is provided a color image forming apparatus comprising first density detecting means for detecting a density of a first detection toner image formed on an image bearing member or a transferring material carrying member and second density detecting means for detecting a density of a second detection toner image formed on a transferring material, and executing image density control based on a detection result of the first density detecting means and a detection result of the second density detecting means, in which a detection light application position of the first density detecting means and a detection light application position of the second density detecting means are almost equal relative to a perpendicular direction to a transferring material conveying direction.

According to yet another aspect of the present invention is provided a color image forming apparatus comprising first density detecting means for detecting a density of a detection toner image formed on an image bearing member and second density detecting means, arranged inside of a main body of the color image forming apparatus or outside of the main body of the color image forming apparatus, for detecting a density of the detection toner image fixed onto a transferring material, in which a density of a common detection toner image is detected by the first density detecting means and the second density detecting means, and a failure of one of the first density detecting means and the second density detecting means is determined in accordance with a detection result of the first density detecting means and a detection result of the second density detecting means for the common detection toner image.

The other objects, constitutions and advantages of the present invention will be apparent from the detailed description and the drawings which follow.

DESCRIPTION OF THE PREFERRED EMBODIMENTS

Embodiments of a color image forming apparatus and a control system for the color image forming apparatus according to the present invention will be described hereinafter.

Figure 1:
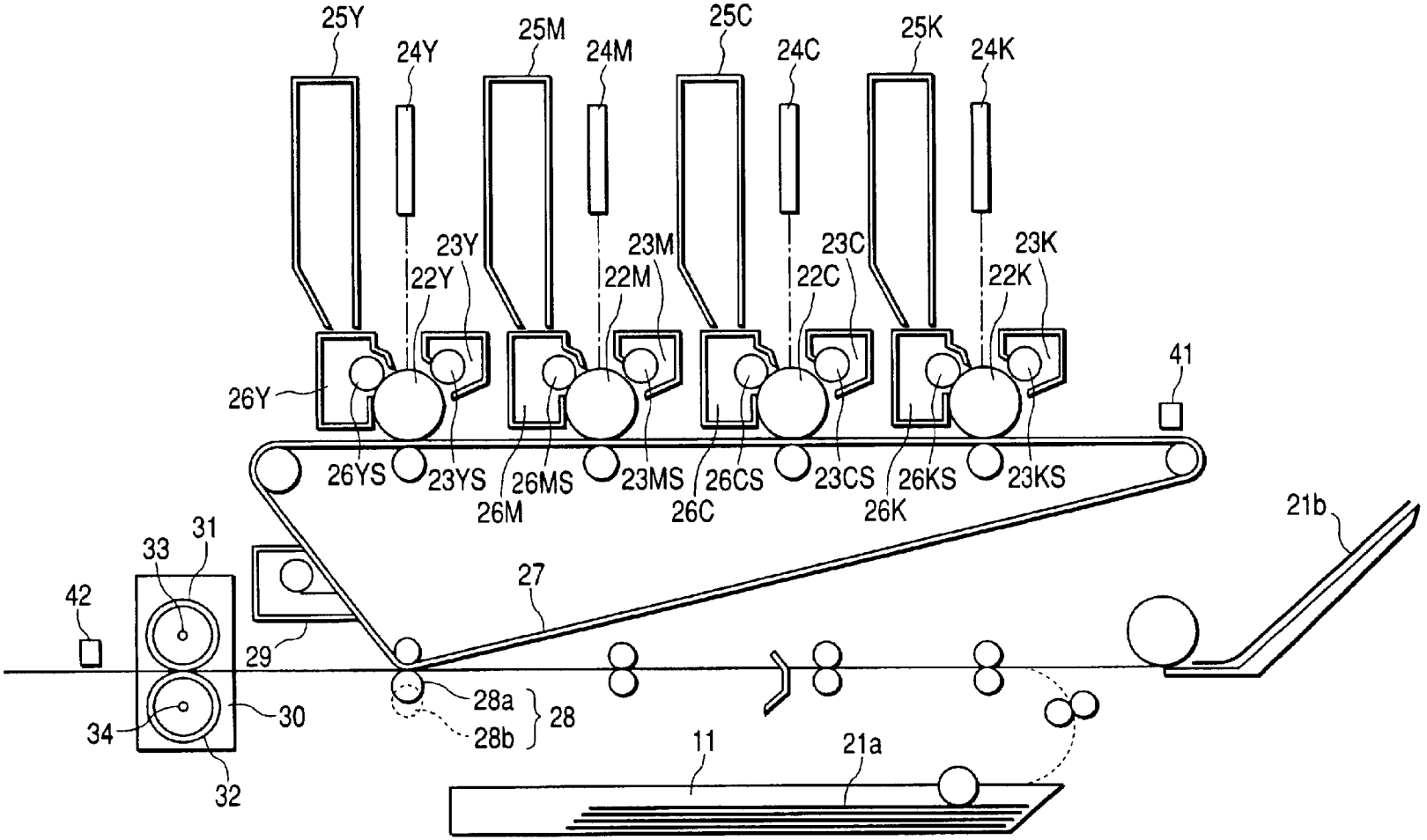
FIG. 1 is a cross-sectional view showing the overall configuration of a color image forming apparatus in a first embodiment according to the present invention.
Figure 2:
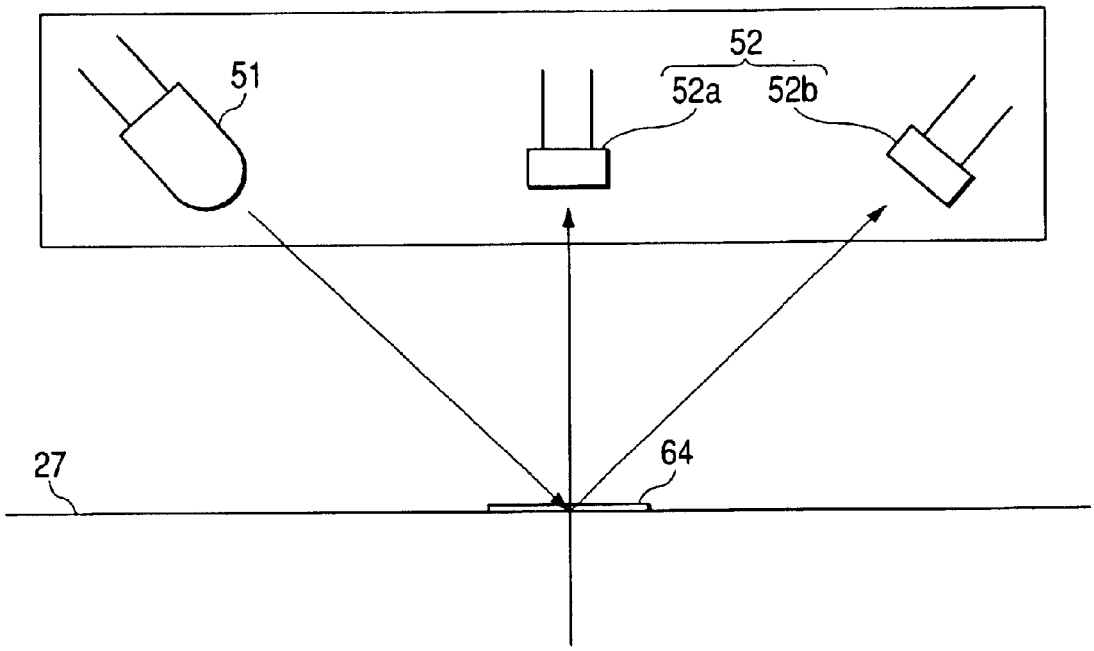
FIG. 2 is an explanatory view showing the configuration of a density sensor.
Figure 3:
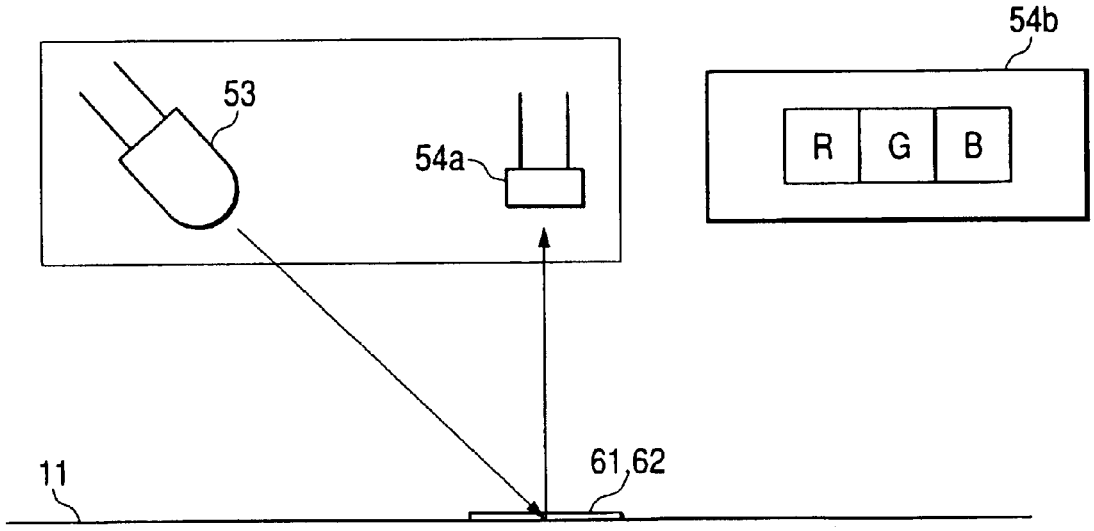
FIG. 3 is an explanatory view showing the configuration of a color sensor.
Figure 4:
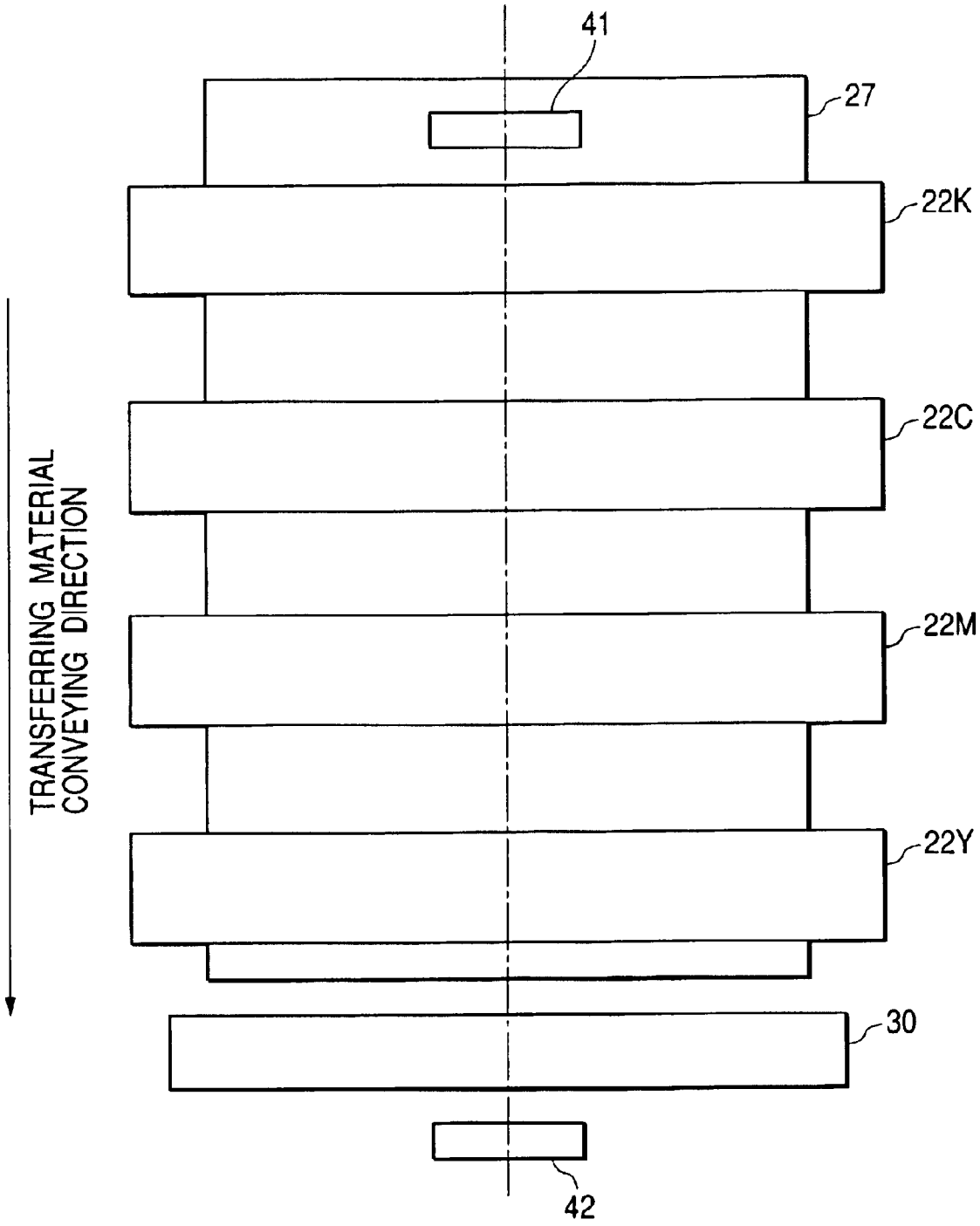
FIG. 4 is an explanatory view showing the arrangement of the density sensor and the color sensor.
Figure 5:
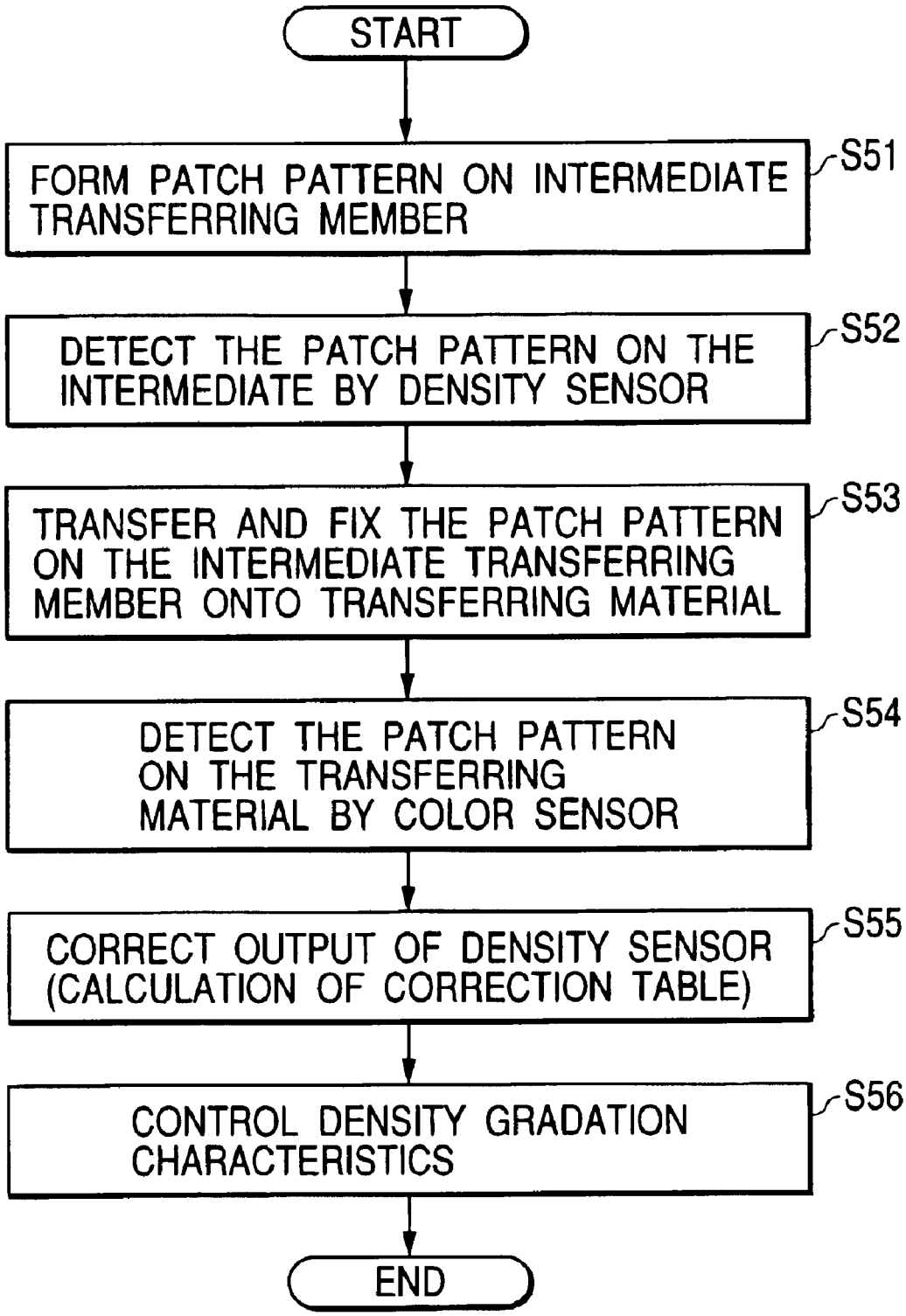
FIG. 5 is a flow chart showing the processing procedures of an image density control system in the first embodiment.
Figure 6:
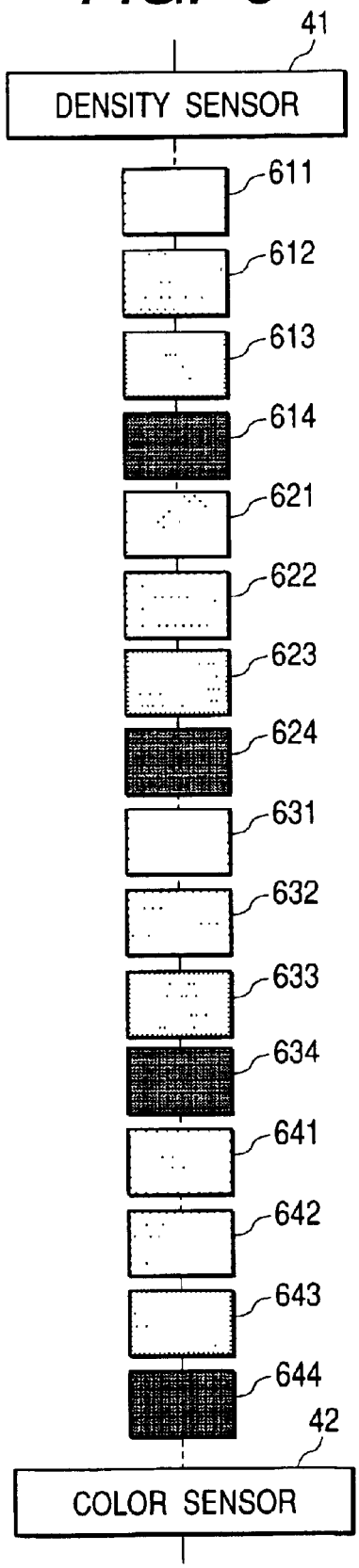
FIG. 6 is an explanatory view showing a patch pattern used in the first embodiment.
Figure 7:
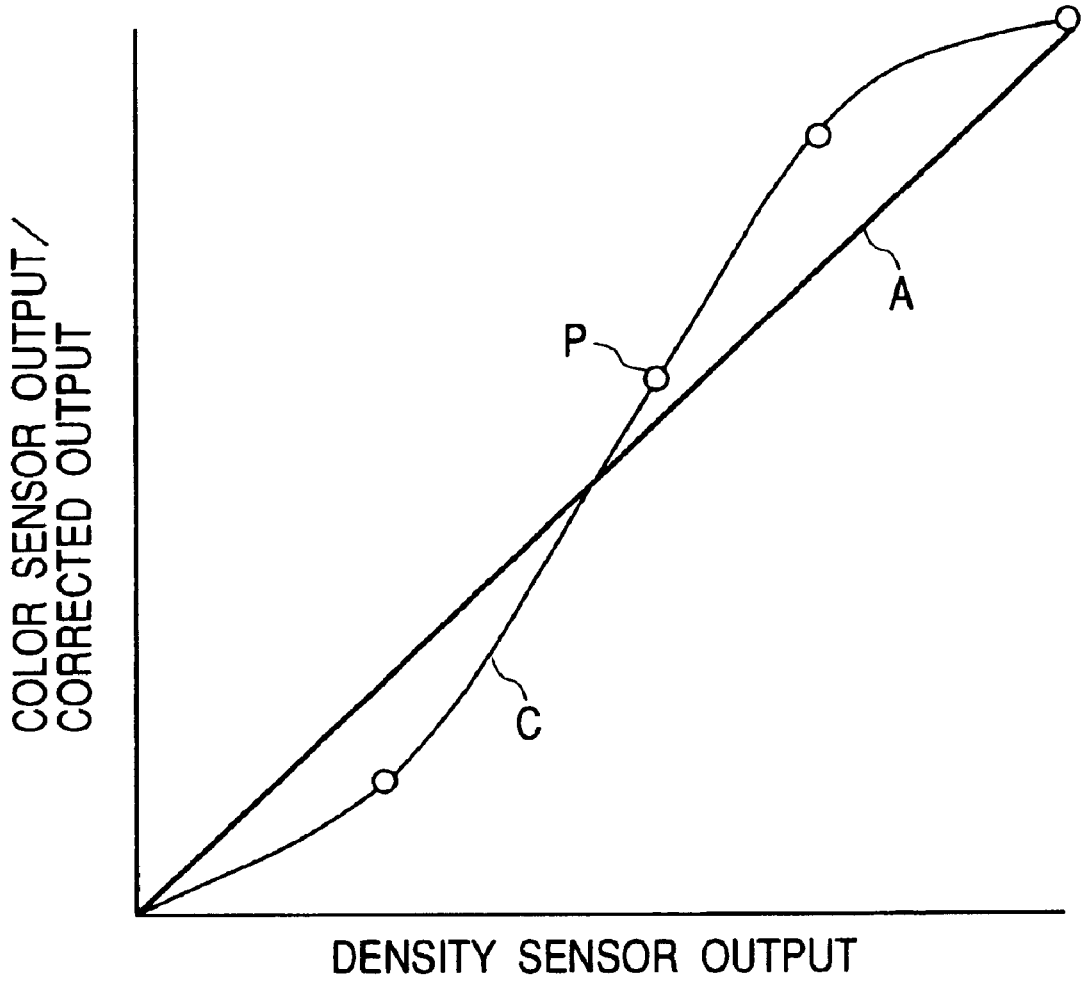
FIG. 7 is a graph showing the relationship between density sensor output and color sensor output/corrected output.
Figure 8:
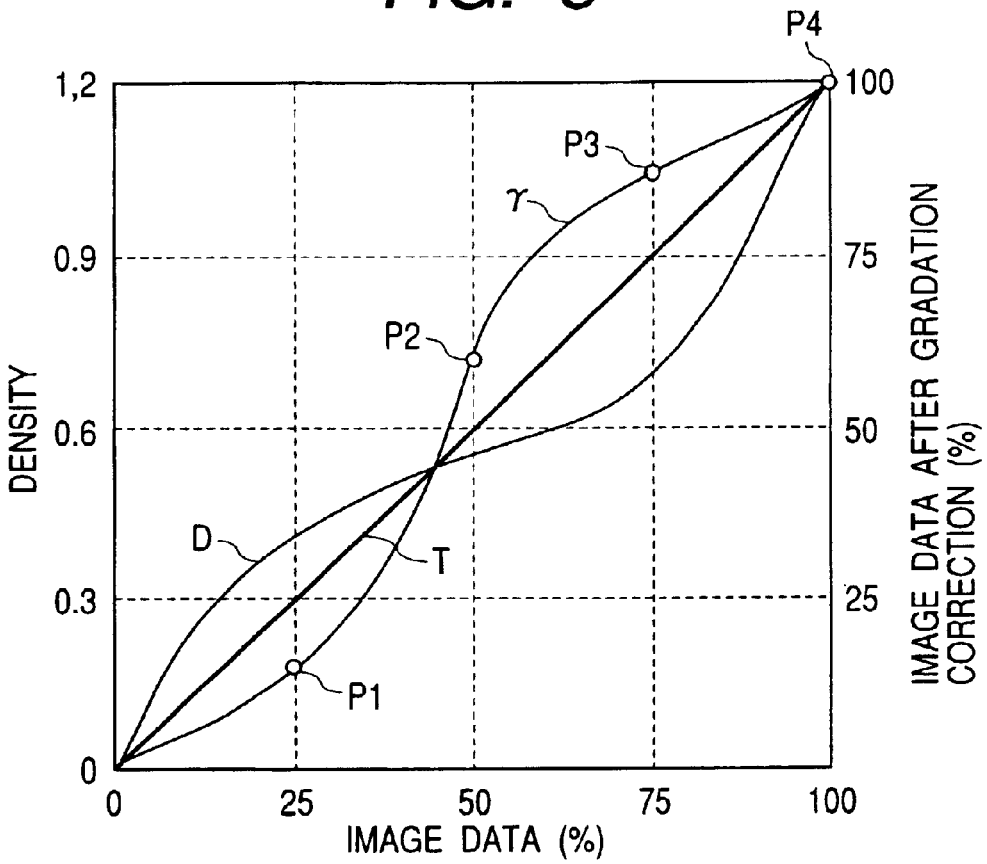
FIG. 8 is a graph showing density gradation correction control.
Figure 9:
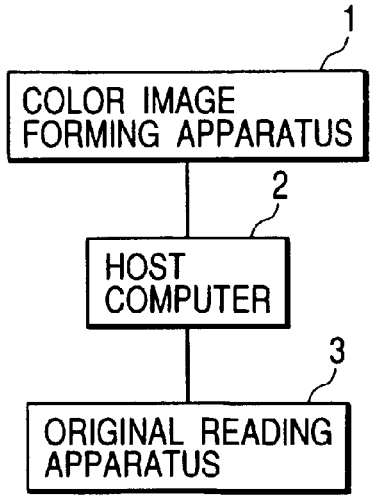
FIG. 9 is a block diagram showing the configuration of a system in a second embodiment according to the present invention.
Figure 10:
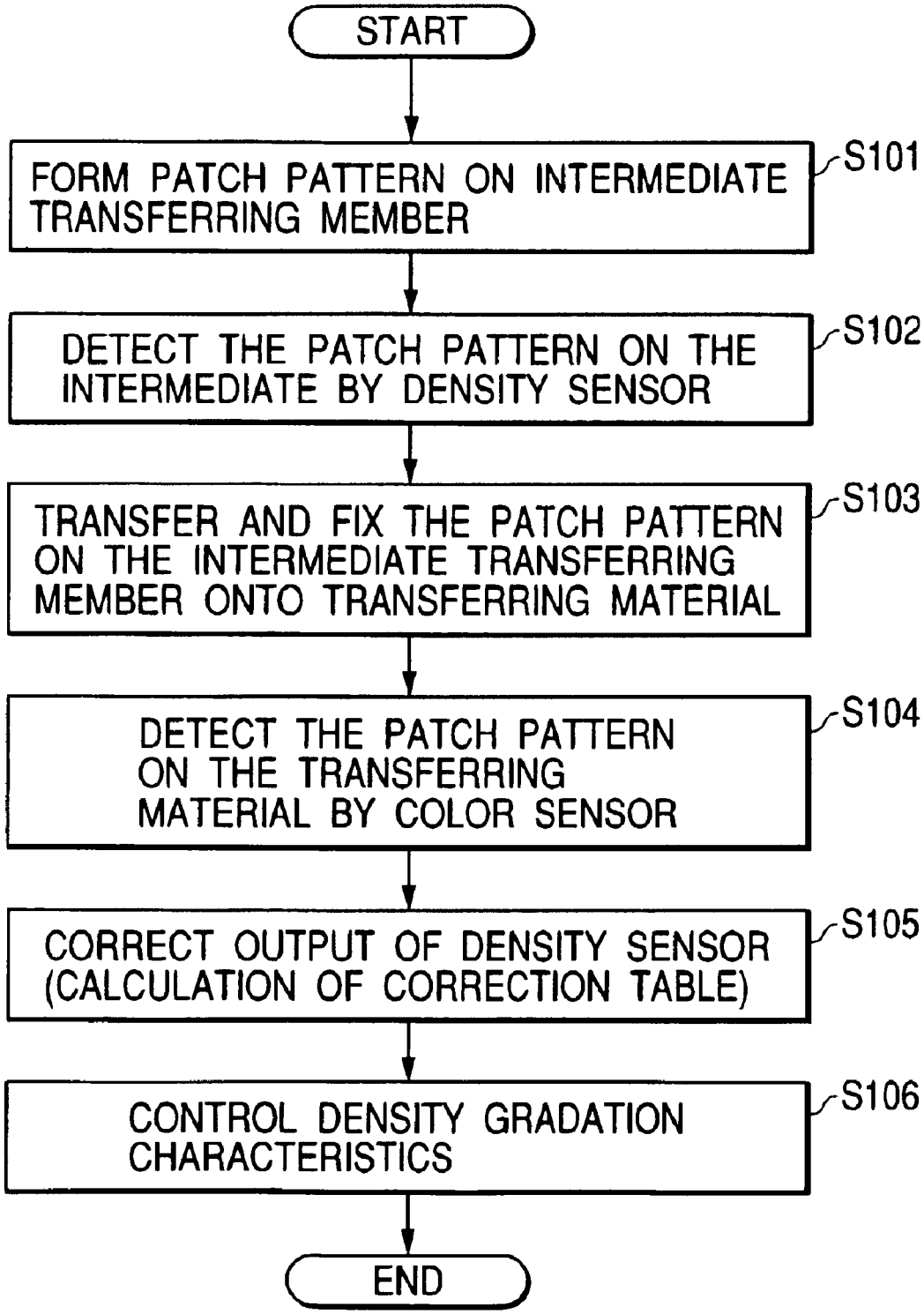
FIG. 10 is a flow chart showing the processing procedures of the image density control system in the second embodiment.
Figure 11:
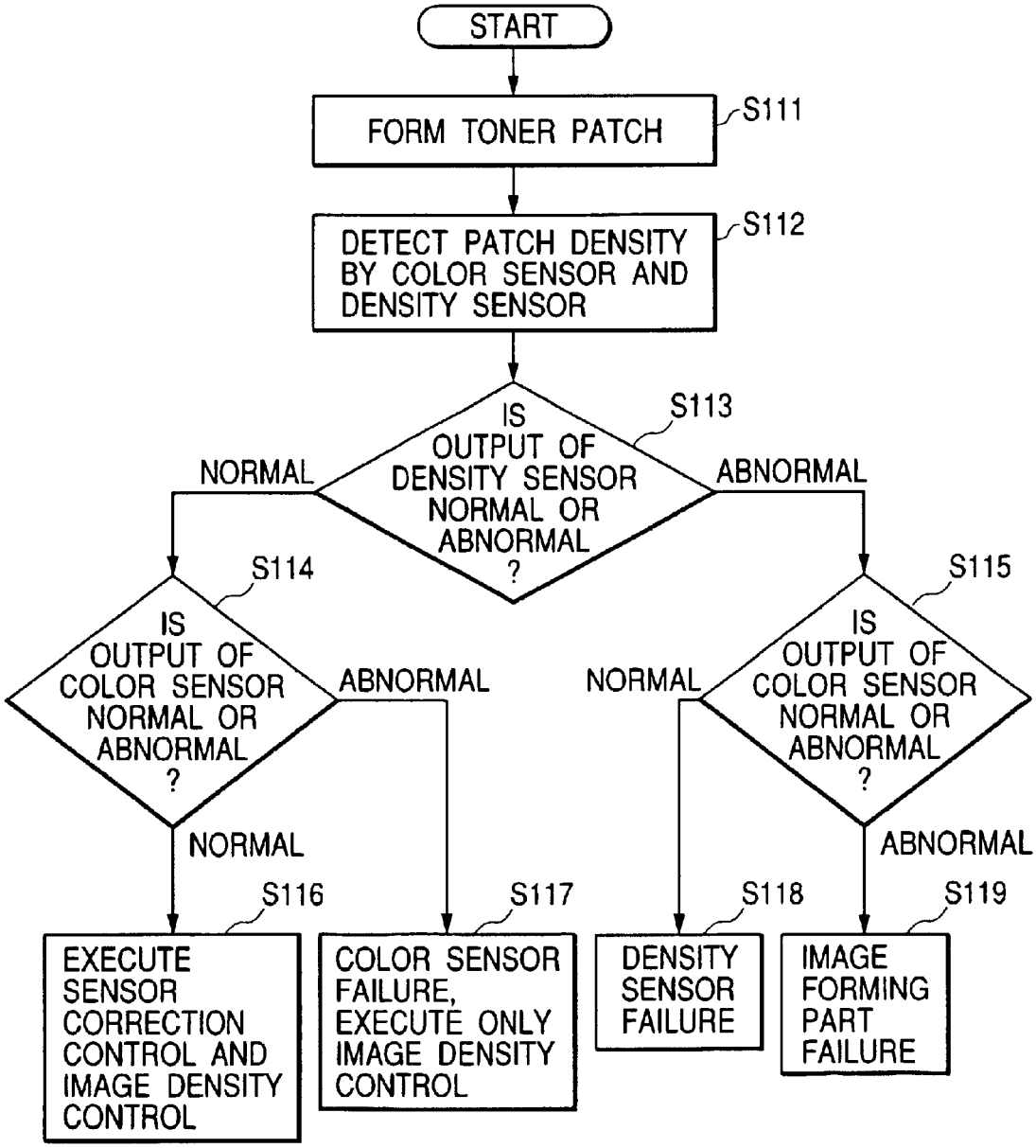
FIG. 11 is a flow chart showing the processing procedures of an image density control system in a third embodiment according to the present invention.

FIG. 1 is a cross-sectional view showing the overall configuration of a color image forming apparatus in a first embodiment of the invention. FIG. 2 is an explanatory view showing the configuration of a density sensor. FIG. 3 is an explanatory view showing the configuration of a color sensor. FIG. 4 is an explanatory view showing the arrangement of the density sensor and the color sensor. FIG. 5 is a flow chart showing the processing procedures of an image density control system in the first embodiment. FIG. 6 is an explanatory view showing a patch pattern used in the first embodiment. FIG. 7 is a graph showing the relationship between density sensor output and color sensor output/corrected output. FIG. 8 is a graph showing density gradation correction control. FIG. 9 is a block diagram showing the configuration of a system in a second embodiment of the invention. FIG. 10 is a flow chart showing the processing procedures of the image density control system in the second embodiment. FIG. 11 is a flow chart showing the processing procedures of an image density control system in a third embodiment of the invention.

The present invention will be described hereinafter in detail based on the embodiments.

(First Embodiment)

FIG. 1 is a cross-sectional view showing the overall configuration of a color image forming apparatus in the first embodiment. As shown in FIG. 1, this apparatus is a tandem color image forming apparatus which employs an intermediate transferring material 27, as one example of an electrophotographic color image forming apparatus. The color image forming apparatus is constituted of an image forming portion shown in FIG. 1 and an image processing portion which is not shown in FIG. 1.

Referring to FIG. 1, the operation of the image forming portion of the electrophotographic color image forming apparatus will be described. The image forming portion forms an electrostatic latent image by exposure light which is turned on based on exposure time changed by the image processing portion, develops the latent image to form monochromatic toner images, registers the monochromatic toner images, thereby to form a multi-color toner image, transfers this multi-color toner image to a transferring material 11, and fixes the multi-color toner image onto the transferring material 11. The image forming portion comprises a paper feeding portion 21*a*, 21*b*, photosensitive members (22Y, 22M, 22C and 22K), injection charging devices (23Y, 23M, 23C and 23K) serving as primary charging means, toner cartridges (25Y, 25M, 25C and 25K) and developing means (26Y, 26M, 26C and 26K) which are provided to correspond to stations aligned for respective developed colors, as well as an intermediate transferring body 27, transferring rollers 28, cleaning means 29, a fixing portion 30, a density sensor 41 and a color sensor 42.

The photosensitive drums (photosensitive members) 22Y, 22M, 22C and 22K are each constituted to have an organic photoconductive layer applied on the outer periphery of an aluminum cylinder and rotated when the driving force of a drive motor (not shown) is transmitted thereto. In FIG. 1, the drive motor rotate the respective photosensitive drums 22Y, 22M, 22C and 22K counterclockwise in accordance with an image forming operation.

The four injection charging devices 23Y, 23M, 23C and 23K, serving as primary charging means, charge yellow (Y), magenta (M), cyan (C) and black (K) photosensitive members for the respective stations. The injection charging devices 23Y, 23M, 23C and 23K are provided with sleeves 23YS, 23MS, 23CS and 23KS, respectively.

Exposure light is applied to the photosensitive drums 22Y, 22M, 22C and 22K from scanner portions 24Y, 24M, 24C and 24K, respectively. By selectively exposing the surfaces of the photosensitive drums 22Y, 22M, 22C and 22K, an electrostatic latent image is formed.

The four developing devices 26Y, 26M, 26C and 26K, serving as developing means, developing yellow (Y), magenta (M), cyan (C) and black (K) for the respective stations are provided to visualize the latent images. The developing devices 26Y, 26M, 26C and 26K are provided with sleeves 26YS, 26MS, 26CS and 26KS, respectively. The respective developing devices are detachably attached to the apparatus.

The intermediate transferring body 27 contacts with the photosensitive drums 22Y, 22M, 22C and 22K. During color image formation, the intermediate transferring body 27 rotates clockwise following the rotation of the photosensitive drums 22Y, 22M, 22C and 22K to transfer monochromatic toner images. Thereafter, the transfer rollers 28, to be described later, contact with the intermediate transferring member 27 to put the transferring material 11 between the rollers 28 and convey the transferring material 11, and a multi-color toner image on the intermediate transferring member 27 is transferred to the transferring material 11.

The transferring rollers 28 are in contact with the transferring material 11 at a position 28*a* while the multi-color toner image is transferred onto the transferring material 11, and out of contact with the transferring material 11 at a position 28*b* after printing process.

The fixing portion 30 fuses and fixes the transferred multi-color toner image while conveying the transferring material 11. As shown in FIG. 1, the fixing portion 30 includes a fixing roller 31 which heats the transferring material 11, and a pressure roller 32 which press-contacts the transferring material 11 with the fixing roller 31. The fixing roller 31 and the pressure roller 32 are formed in a hollow fashion, and include therein heaters 33 and 34, respectively. Namely, the transferring material 11 which holds the multi-color toner image, is conveyed by the fixing roller 31 and the pressure roller 32, and heat and pressure are applied to the transferring material 11, and toner is thereby fixed onto the surface of the transferring material 11.

The transferring material 11 onto which the toner image has been fixed, is discharged to a discharge tray (not shown) by a discharge roller (not shown), thus completing the image forming operation.

The cleaning means 29 cleans the toners remaining on the intermediate transferring member 27. Waste toners after four toner images formed on the intermediate transferring member 27 are transferred onto the transferring material 11 are contained in a cleaner container.

The density sensor 41, which is arranged toward the intermediate transferring body 27 in the color image forming apparatus shown in FIG. 1, measures the density of a toner patch formed on the surface of the intermediate transferring body 27. FIG. 2 shows one example of the configuration of this density sensor 41. The density sensor 41 includes an infrared light emitting element 51 such as LED, light receiving elements 52 (52*a* and 52*b*) such as photodiodes or Cds, and a holder (not shown) which contains IC and the like (not shown) for processing light receiving data.

The light receiving element 52*a* detects the intensity of irregularly reflecting light from a toner patch 64, and the light receiving element 52*b* detects the intensity of regularly reflecting light from the toner patch 64, whereby the density of the toner patch 64 from high to low densities can be detected. It is noted that an optical element such as a lens (not shown) is sometimes used to connect the light emitting element 51 to the light receiving elements 52.

The color sensor 42 is arranged toward the image forming surface of the transferring material 11 downstream of the fixing portion 30 on a transferring material conveying path in the color image forming apparatus shown in FIG. 1. The color sensor 42 detects the RGB output values of a fixed, mixed color patch formed on the transferring material 11. By arranging the color sensor 42 in the color image forming apparatus, it is possible to automatically detect a fixed image before the transferring material 11 is discharged to the discharging portion.

FIG. 3 shows one example of the configuration of the color sensor 42. The color sensor 42 includes a white color LED 53 and a RGB on-chip filter-added charge accumulation sensor 54*a*. Light from the white color LED 53 is made incident on the transferring material 11, on which the fixed patch 61, 62 is formed, diagonally at an angle of 45 degrees, and the RGB on-chip filter-added charge accumulation sensor 54*a* detects the intensity of irregularly reflecting light in a direction of 0 degree (perpendicular direction). The light receiving portion of the RGB on-chip filter-added charge accumulation sensor 54*a* has independent RGB pixels as indicated by reference number 54*b*.

The RGB on-chip filter-added charge accumulation sensor 54 can be comprised of a photo-diode. A set of the three pixels of RGB can be arranged in rows. In addition, the incidence angle can be set at 0 degree and the reflection angle can be 45 degrees. And furthermore, a LED capable of emitting three colors of RGB and a filter-less sensor can be employed as the RGB on-chip filter-added charge accumulation sensor 54.

It is noted that the density sensor 41 and the color sensor 42 are arranged at a central position in the longitudinal direction of a main body (a direction orthogonal to a transferring material conveying direction) as shown in FIG. 4. That is, the density sensor 41 and the color sensor 42 are arranged at the same position in the longitudinal direction. This arrangement is one feature of the present invention. By thus arranging the density sensor 41 and the color sensor 42, it is possible to detect the density of the patch at the same position by the density sensor 42 and the color sensor 42. In other words, the density detection is not influenced by the positional patch density difference (density difference between the positions in the longitudinal direction in this case).

Figure 14:
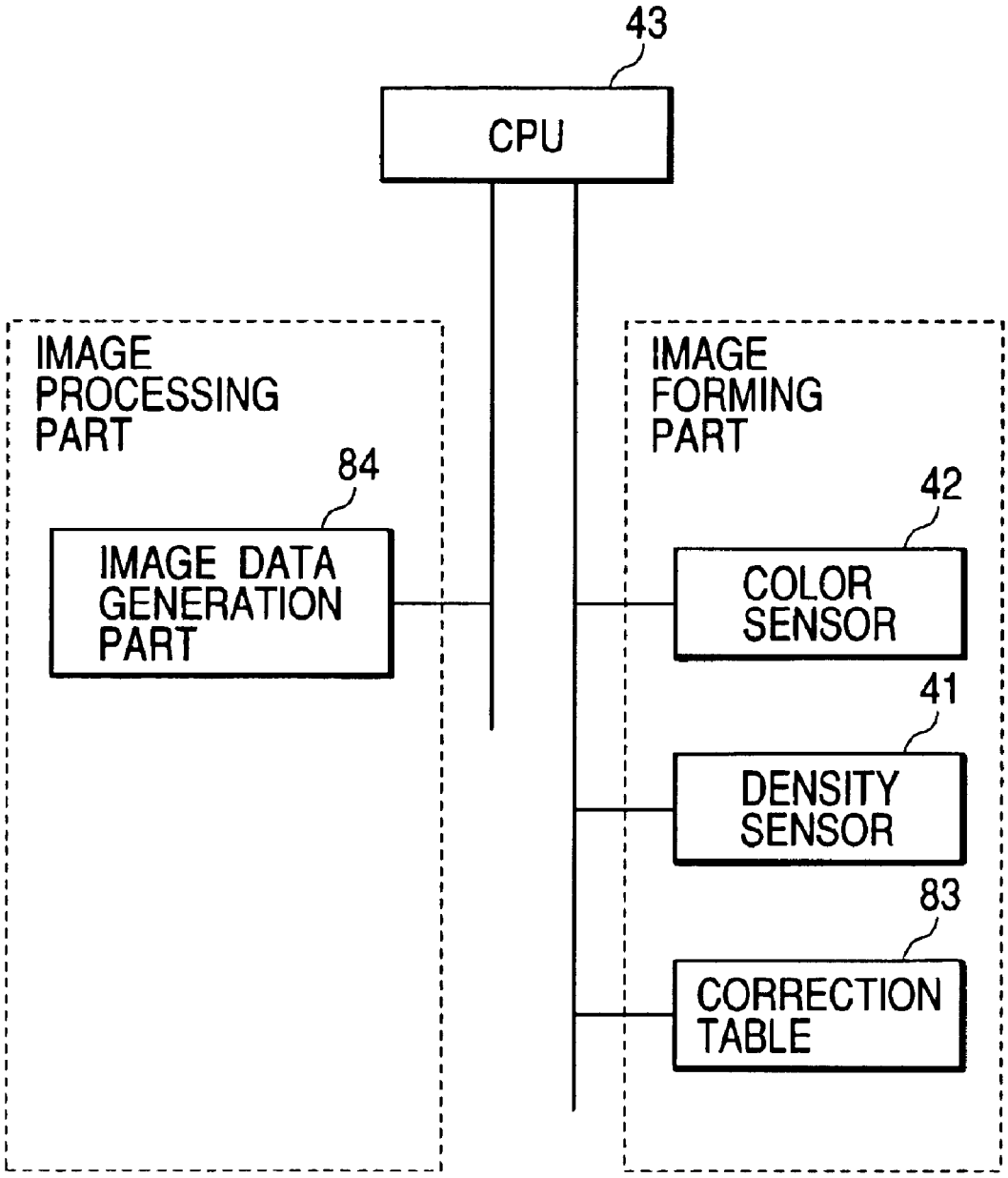
FIG. 14 shows an electric system related to density-gradation characteristic control.

FIG. 14 shows an electric system related to density-gradation characteristic control in the image forming apparatus of the present invention. An image data generation portion 84 belongs to the image processing portion, and the density sensor 41, the color sensor 42, and a correction table 83 belong to the image forming portion. In addition, the detection result of the density sensor 41 is corrected by the correction table 83 and then transferred to the image processing portion. Processing is controlled by a CPU 43.

FIG. 5 is a flow chart showing density sensor correction control and image density control executed simultaneously with the density sensor correction control. In this embodiment, the color sensor 42 is employed to control density. That is, since the toner image fixed onto the transferring material 11 is required, it is preferable to minimize control executing. In this embodiment, if a user wants to execute density sensor correction control, the correction control is executed by the manual operation of the user.

A control flow will be described.

In a step S51, a patch pattern for sensor correction control and density control is formed on the intermediate transferring member 27.

FIG. 6 shows the correction patch pattern to be formed.

The control patch pattern includes a total of 16 patches of yellow gradation patches 611, 612, 613 and 614, magenta gradation patches 621, 622, 623 and 624, cyan gradation patches 631, 632, 633 and 634, and black gradation patches 641, 642, 643 and 644. A gradation pattern printing rate (image data corresponding to halftone patches) is set at 25% for the patches 611, 621, 631 and 641, 50% for the patches 612, 622, 632 and 642, 75% for the patches 613, 623, 633 and 643, and 100% for the patches 614, 624, 634 and 644.

In a step S52, the densities of the patches formed in the step S51 are detected by the density sensor 41.

In a step S53, a transferring material is fed by the paper feeding portion 21, and the control patch pattern on the intermediate transferring body 27 is transferred onto the transferring material. The patch pattern on the transferring material is fixed by the fixing portion 30.

In a step S54, the densities of the toner patches fixed onto the transferring material in the step S53 are detected by the color sensor 42.

The density detection result obtained includes irregularities of transferring characteristics for transferring the toner image onto the transferring material and the influence of the fluctuation of fixing characteristics. Therefore, compared with a case where unfixed toners are detected by the density sensor, the detection result shows highly accurate values.

In a step S55, the output of the density sensor 41 is corrected. A method for correcting the density sensor 41 will be described with reference to FIG. 7. In FIG. 7, the horizontal axis represents the detection result of the density sensor 41, and the vertical axis represents that of the color sensor 42. In FIG. 7, a white-circle point P shows the relationship between the detection result in the step S54 (the result obtained by detecting the toner patches on the transferring material by the color sensor) and that in the step S52 (the result obtained by detecting the toner patches on the intermediate transferring member 27 by the density sensor).

A line A represents a case where the output of the density sensor is equal to that of the color sensor, i.e., there is no measurement error in the density sensor (note that since the color sensor detects the density on the transferring material and is, therefore, high in density detection accuracy, it is assumed that the color sensor includes no measurement error). In FIG. 7, the point P does not coincide with line A. This means that the density sensor has slight measurement error.

Next, the correction table (a curve C in FIG. 7) of the density sensor 41 is calculated. The correction table C is a curve which passes the point P. In respect of gradation density when no patches are formed (density of the gradation between patches), the correction table C is calculated by spline-interpolating an origin and the point P. The correction table C is calculated for respective colors (yellow, magenta, cyan and black). Further, the calculation of the correction table C is executed by a main body CPU (not shown) included in the apparatus and the calculated correction table C is stored in an illustrated main body memory (which is a nonvolatile memory in this embodiment) included in the apparatus.

The density sensor 41 is thus corrected by the above-stated method.

Next, in a step S56, image density control is executed. In this embodiment, the image density control signifies density gradation characteristic control for correcting the density characteristics of an image. The density gradation characteristic control will be described with reference to FIG. 8.

In FIG. 8, the horizontal axis represents image data, and the vertical axis represents the density detection result of the density sensor 41.

Further, in FIG. 8, points P1, P2, P3 and P4 represent results obtained by detecting the toner patches on the intermediate transferring body by the density sensor 41. The detected density is a value after executing correction by the correction table C calculated in the step S55.

A line T represents target density gradation characteristics for the image density control. In this embodiment, the target density gradation characteristics T is determined so that the image data is proportional to the density. A curve γ represents density gradation characteristics while no density control (gradation correction control) is executed. The gradation density when no patches are formed is calculated by spline-interpolating the origin and the points P1, P2, P3 and P4.

A curve D represents a gradation correction table calculated by this control. The curve D is calculated by obtaining symmetric points relative to the target gradation characteristics of the gradation characteristics γ before correction.

The calculation of the gradation correction table D is executed by the main body CPU (not shown) and the calculated gradation correction table D is stored in the unillustrated main body memory (nonvolatile memory in this embodiment) included in the apparatus.

When forming a printed image, the target gradation characteristics can be obtained by correcting image data by the gradation correction table D.

The density sensor correction control and the image density control executed simultaneously with the density sensor correction control in this embodiment have been thus described.

In this image forming apparatus, normal image density control apart from the above-stated controls is regularly executed by the density sensor 41. Needless to say, the regular image density control employs unfixed patches, so that the transferring material is not required. In addition, in the color image forming apparatus in this embodiment, the regular image density control is executed every time a developing device or a photosensitive drum is exchanged or every time a predetermined number of sheets are printed while power is turned on. In other words, the regular image density control is executed if density change is predicted. During the control, the output of the density sensor is always corrected by the correction table C already calculated. Further, the method for controlling the image density executed in this embodiment is the same as that for controlling the density gradation characteristics described with reference to FIG. 8. Accordingly, whenever,the regular image density control is executed, the gradation correction table D is updated.

If changes in transferring conditions and fixing conditions are predicted (it is predicted, for example, that an apparatus installation location, i.e., apparatus use environment is changed when exchanging the intermediate transferring member or the fixing device), a user executes the density sensor correction control and the image density control simultaneously, whereby the correction table C and the gradation correction table D of the density sensor are updated.

In this embodiment, the density sensor correction control is executed so as to correct changes in the toner transferring characteristics and fixing characteristics relative to the transferring material. Alternatively, the output density of the color sensor may be compared with that of the density sensor so as to correct the target density gradation characteristics T.

In this embodiment, the patches used for the correction of the density sensor 41 and those used for the image density control are common. However, all the patches are not necessarily common to the density sensor correction control and the image density control. For example, if the patches necessary for the density sensor correction control are fewer than the patches necessary for the image density control, several patches may be selected from the patches for the image density control as the patches for the density sensor correction control. As long as not less than one patch is common, the intended advantages of the present invention can be obtained.

Further, in this embodiment, to control the image density, a plurality of patches are formed from a plurality of stages of gradation patterns, the density gradation characteristics of the engine are calculated from density curves thereof, and a gradation correction look-up table for obtaining predetermined gradation characteristics according to the calculation result is calculated. However, the density control method is not limited thereto but the other method may be used For example, a plurality of predetermined pattern (e.g., halftone pattern) patches obtained by changing charging conditions or the like to a plurality of stages may be formed on the intermediate transferring member, the densities of the patch patterns may be detected, and developing conditions and charging conditions may be calculated so as to obtain a desired density.

In this embodiment, the color image forming apparatus which detects patches on the intermediate transferring member by the density sensor has been explained by way of example. The method for arranging the density sensor and the color sensor at the longitudinally same position, thereby to decrease the influence of density difference in the longitudinal direction, is also effective in a color image forming apparatus which detects patches on a transferring member carrier such as a transferring belt by a density sensor.

In the first embodiment stated above, the corrections of changes in the toner transfer characteristic and fixing characteristic relative to the transferring material, i.e., the correction of the density sensor and the image density control are simultaneously executed. Therefore, compared with a case of controlling the controls independently of each other, it is possible to shorten the time required to execute overall controls.

Furthermore, by making the fixed patches used for the density sensor correction and the unfixed patches common, it is possible accurately to correct the density sensor without being influenced by the density change which occurs in a short period of time or by the density difference which occurs due to the difference in image formation position. Hence, it is possible to provide a color image forming apparatus having improved accuracy for image density control and excellent in density stability.

(Second Embodiment)

In the second embodiment, a method for shortening density control time and preventing the deterioration of density control accuracy resulting from a temporal change and a positional change in detection toner patch density if density sensor correction control and density control are executed using original reading means (including the original reading apparatus of a copier) outside of the apparatus or external density detecting means, will be described.

It is noted that the second embodiment is a development of the first embodiment and that the second embodiment differs from the first embodiment only in that the original reading means (including the original reading apparatus of a copier) outside of the apparatus or the external density detecting means is used in place of the color sensor.

FIG. 9 is a block diagram showing the configuration of a system used in this embodiment. The system includes a color image forming apparatus 1, a host computer 2 connected to the color image forming apparatus 1, and an external original reading apparatus 3.

The main constituent elements of the color image forming apparatus 1 are almost equal to those of the color image forming apparatus used in the first embodiment except that the color sensor 42 is not provided. Further, the original reading apparatus 3 is a commercially available flat bed scanner and connected to the host computer.

Next, density sensor correction control and image density control executed simultaneously with the density sensor correction control in this embodiment will be described with reference to a flow chart of FIG. 10.

In the control in this embodiment, the original reading apparatus 3 is employed. That is, a toner image fixed onto a transferring material is required. It is, therefore, preferable to minimize executing control frequency. In this embodiment, if a user wants to execute the density sensor correction control, the control is executed by the manual operation of the user.

A control flow will be described.

In step S101, a patch pattern for sensor correction control and density control is formed on the intermediate transferring body 27.

The pattern shown in FIG. 6 is used as the control patch pattern as in the case of the first embodiment.

In step S102, the density of the toner patch pattern formed in the step S101 is detected by the density sensor 41. The detected density date is transmitted to the host computer 2.

In step S103, a transferring material is fed by the paper feeding portion 21, and the control patch pattern on the intermediate transferring member is transferred onto the transferring material 11 by the transferring rollers 28. The patch pattern on the transferring material is fixed by the fixing portion 30. Thereafter, the transferring material, on which the patch pattern has been formed, is discharged from the color image forming apparatus 1.

Next, in step S104, the density of the patch pattern printed in the step S103 is detected by the original reading apparatus 3.

It is noted that the user sets the transferring material on which the patch pattern is printed to the original reading apparatus 3.

The detected density data is transmitted to the host computer 2.

In step S105, the output of the density sensor 41 is corrected. A sensor correcting method is the same as that in the first embodiment; however, the calculation of the correction table C is executed by the host computer 2.

The calculated correction table C is transmitted from the host computer 2 to the color image forming apparatus 1 and then stored in a main body memory (a nonvolatile memory in this embodiment) included in the color image forming apparatus 1.

The density sensor 41 is corrected by the above-stated method.

Next, in step S106, image density control is executed. In this embodiment, the image density control signifies density gradation characteristic control for correcting the density gradation characteristics of an image. A control method is the same as that in the first embodiment.

The density sensor correction control and the image density control executed simultaneously with the density sensor correction control are thus executed by the above-stated method in this embodiment.

In the second embodiment as in the case of the first embodiment, normal image density control apart from the above-stated controls is regularly executed by the density sensor 41. Needless to say, the gradation correction table D is updated whenever the normal regular image density control is executed.

If changes in transferring conditions and fixing conditions are predicted, a user executes the density sensor correction control and the image density control simultaneously, whereby the correction table C and the gradation correction table D of the density sensor are updated.

In this embodiment, the density sensor correction control is executed so as to correct changes in the toner transferring characteristic and fixing characteristics relative to the transferring material. Alternatively, the output density of the original reading apparatus 3 may be compared with that of the density sensor so as to correct the target density gradation characteristics T.

In this embodiment as in the case of the first embodiment, the patches used for the correction of the density sensor and those used for the image density control are not necessarily common. As long as at least one patch is common, the intended advantages of the present invention can be obtained.

Further, in this embodiment, as external density detecting means, the original reading apparatus (flat bed scanner) is employed. However, the external density detecting means is not limited thereto. For example, a density measuring instrument connectable to the host computer 2 or an original reading apparatus such as a copier may be available. Needless to say, if the present invention is applied to a copier with the original reading apparatus, the host computer 2 may not be provided.

In this embodiment, even if the density detecting means outside of the apparatus is employed, it is possible to shorten time required to execute overall controls. Further, by making the fixed patches used for the density sensor correction and the unfixed patches common, it is possible to accurately correct the density sensor without being influenced by the density change which occurs in a short period of time or by the density difference which occurs due to the difference in image formation position. Hence, it is possible to provide a color image forming apparatus having improved accuracy for image density control and excellent in density stability.

(Third Embodiment)

In the third embodiment, a method for detecting the same patch by a color sensor and a density sensor and for determining whether the respective sensors fail will be described. It is desirable that the present invention is carried out in combination with the first embodiment. In the third embodiment, therefore, an example in which the third embodiment is combined with the first embodiment will be described.

FIG. 11 is a flow chart showing sensor failure determination control in this embodiment.

A control flow shown in FIG. 11 will be described.

In step S111, toner patches are formed. Each toner patch is formed on an intermediate transferring member, transferred onto a transferring material and then fixed onto the transferring material. The details are the same as those described in the first embodiment.

In step S112, the patch density is detected by the color sensor and the density sensor.

In step S113, it is determined whether the output value of the density sensor is normal. It is noted that if all the patch outputs are 0, it is determined that the output value of the density sensor is abnormal.

In steps S114 and S115, it is determined whether the output value of the color sensor is normal. It is noted that if all the patch outputs are 0, it is determined that the output value of the color sensor is abnormal.

If the output values of both the density sensor and the color sensor are normal, sensor correction control and image density control are executed in step S116.

If only the output value of the density sensor is normal, it is determined that the color sensor fails. In this case, in step S117, the sensor correction control is not executed but only the image density control is executed.

If only the output value of the color sensor is normal, it is determined that the density sensor fails in step S118. In this case, neither the sensor correction control nor the image density control is executed.

If the output values of both the color sensor and the density sensor are abnormal, it is determined that the image forming portion fails in step S119.

The sensor failure determination is thus controlled in this embodiment.

If the failure of the sensor(s) is detected, an optimum method for processing (by the user or the main body) may be set in accordance with the image forming apparatus to which the present invention is applied.

In the color image forming apparatus used in this embodiment, the density sensor and the color sensor are set as service exchange portions. Therefore, a sensor failure is displayed on a display panel to notify the user of the occurrence of a sensor failure and to thereby urge the user to conduct service exchange.

The control in this embodiment is characterized as follows. Since the failure determination is conducted by combining the output of the density sensor with that of the color sensor, it is possible to determine the failure of the image forming portion and that of the sensor(s) clearly separately from each other. Further, since the patches used for the failure determination of the density sensor and the color sensor are common, it is possible to shorten time required for the failure determination control.

Moreover, since the patches used for the sensor failure determination and those for the image density control are common, it is possible to further shorten time.

In this embodiment, an example of combining the third embodiment with the first embodiment has been described as an example in which the advantages of the present invention can be exhibited to the maximum. Needless to say, even if the sensor failure determination control in this embodiment is solely executed, the same advantages can be obtained.

As stated so far, changes in toner transferring characteristics and fixing characteristics relative to the transferring material, i.e., the density sensor correction control and the image density control are simultaneously executed. Compared with a case where the controls are independently executed, it is possible to shorten time required for overall controls.

Moreover, by making the fixed patches used for the density sensor correction and the unfixed patches common, it is possible accurately to correct the density sensor without being influenced by the density change which occurs in a short period of time or by the density difference which occurs due to the difference in image formation position. Hence, it is possible to provide a color image forming apparatus having improved accuracy for image density control and excellent in density stability.

Furthermore, even if the density detecting means outside of the apparatus is used, it is possible to shorten time required to execute overall controls and accurately to correct the density sensor without being influenced by a density change which occurs in a short period of time or density difference which occurs due to the difference in image formation position.

Moreover, since the failure determination is conducted while combining the output of the density sensor with that of the color sensor, it is possible to determine the failure of the image forming portion and that of the sensor(s) clearly separately from each other. Further, since the patches used for the failure determination of the density sensor and the color sensor are common, it is possible to shorten the time required for the failure determination control.

(Fourth Embodiment)

In the fourth embodiment, an example in which the detection accuracy of the color sensor 42 is not deteriorated, i.e., the correction accuracy of the density sensor is not deteriorated even if the color sensor 42 has a large irregularity in light receiving characteristics, will be described.

Generally, the spectral reflectance (wavelength characteristic relative to light absorption) of color toners does not coincide with the spectral transmittance of RGB filters used in a color sensor. Therefore, if the spectral characteristics of the RGB filters used in the color sensor are irregular, the toner quantities of the color toners and sensor output differ among sensors. In this embodiment, a method for accurately detecting the quantity of toners on a transferring material by a color sensor and to correct a density sensor more accurately even if there are such difference, will be described.

It is noted that the fourth embodiment is a development of the first embodiment and the overall configuration of a color image forming apparatus used herein is the same as that shown in FIG. 1 and will not be described herein.

Figure 12:
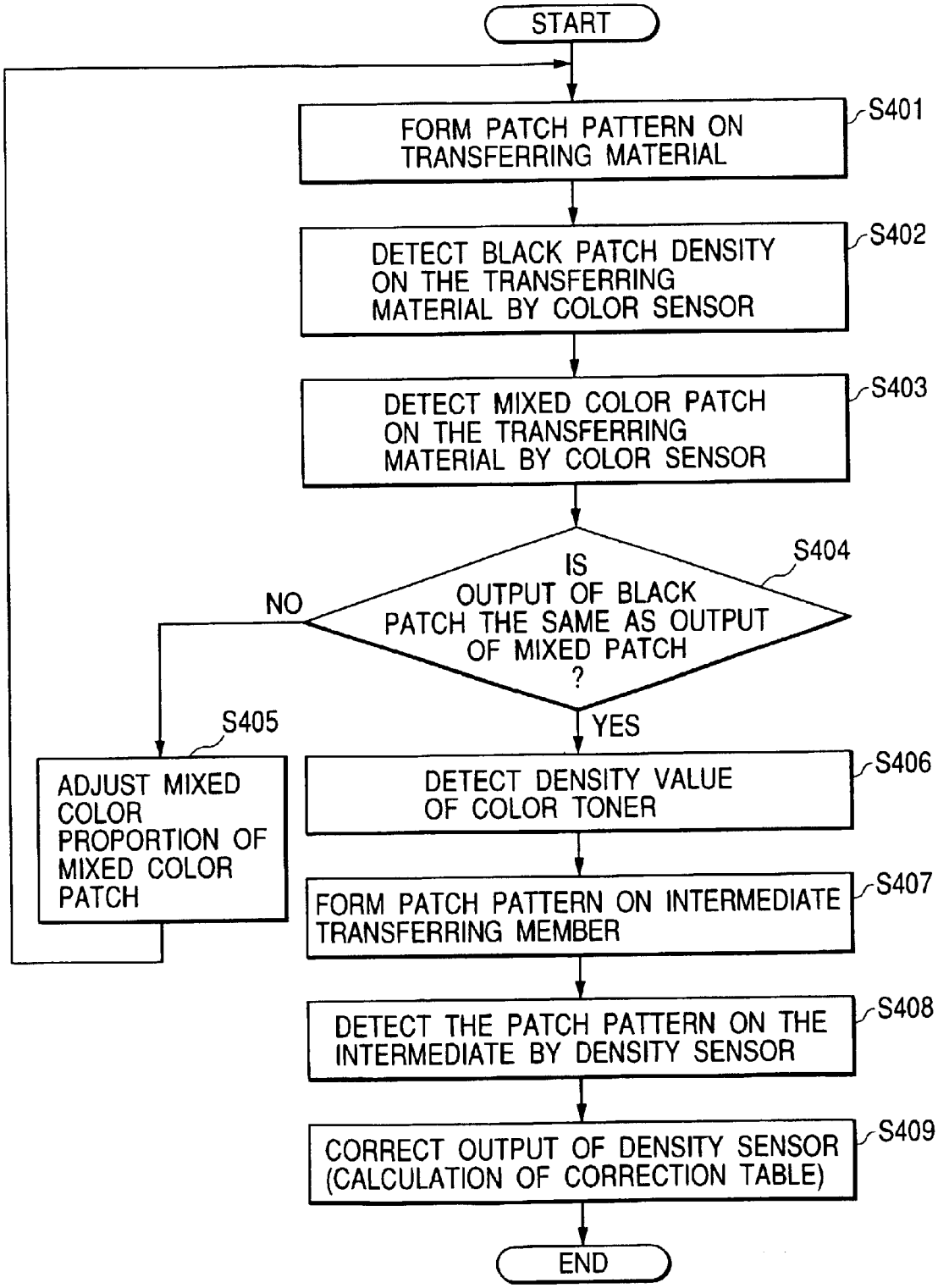
FIG. 12 is a flow chart showing a density sensor correction method in a fourth embodiment according to the present invention.

A method for correcting the density sensor 41 in this embodiment will now be described with reference to a flow chart of FIG. 12.

First, in step S401, a sensor correction patch pattern fixed onto a transferring material is formed.

Figure 13:
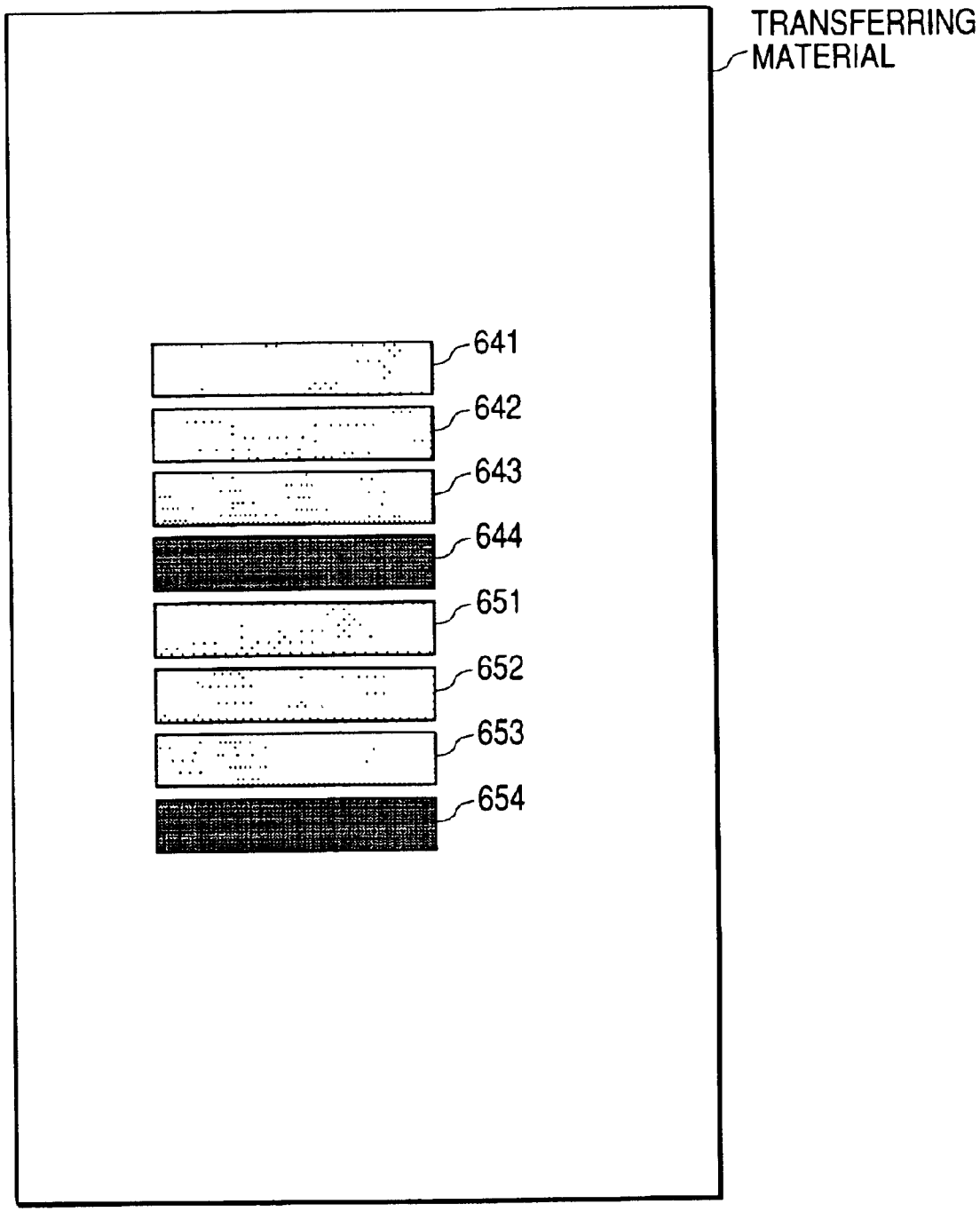
FIG. 13 is an explanatory view showing a correction patch pattern used in the fourth embodiment.

FIG. 13 shows the correction patch pattern used in this embodiment.

The correction patch pattern includes a total of eight patches of black gradation patches 641, 642, 643 and 644, yellow, magenta and cyan mixed color toner patches 651, 652, 653 and 654.

The fourth embodiment is characterized by using the mixed color toner patches 651, 652, 653 and 654 for color toner detection. It is noted that the mixed color toner patches 651, 652, 653 and 654 are formed with a predetermined mixed color proportion with which it is estimated that the output values of the black gradation patches 641, 642, 643 and 644 are almost equal to that of the color sensor. The toner patch 641 corresponds to the toner patch 651, the toner patch 642 corresponds to the toner patch 652, the toner patch 643 corresponds to the toner patch 653, and toner patch 644 corresponds to the toner patch 654, respectively.

In step S402, the densities of the black gradation patches 641, 642, 643 and 644 among those formed in step S401 are detected by the color sensor 42. Normally, the spectral characteristic (light absorption characteristic) of a black toner patch is flat relative to wavelength and the black toner patch is not, therefore, influenced by the irregularities of the filters of the color sensor. Accordingly, black toner density detection is executed in the same method as that described in the first embodiment.

In step S403, the mixed color gradation patches 651, 652, 653 and 654 among those formed in the step S401 are detected by the color sensor 42.

In step S404, the sensor output values of the black monochromatic toner patches detected in step S402 are compared with those of the mixed color patches detected in step S403. If the R, G and B sensor output values are all coincident, the processing proceeds to step S406.

If the R, G and B sensor output values are not coincident, the mixed color proportion of the mixed color toner patches is adjusted in step S405.

To adjust the mixed color proportion, if the R output value is high, the quantity of a cyan toner complementary to a red toner increases, and if the R output value is low, the quantity of a cyan toner decreases. Likewise, for the G output value, the quantity of a magenta toner is adjusted. For the B output value, the quantity of a yellow toner is adjusted. The adjustment of the mixed color proportion is made for the mixed color gradation patches 651, 652, 653 and 654, independently of one another.

After the adjustment of the mixed color proportion, the processing returns to step S401.

The adjustment of the mixed color proportion is repeatedly executed until the output values of all the mixed color patches are equal to those of the black patches.

In step S406, the densities of yellow, magenta and cyan are calculated. In the density calculation, a preset conversion table is used.

The conversion table consists of a combination of the density of the black monochromatic toner and those of monochromatic densities of yellow, magenta and cyan toners equal in spectral characteristic relative to the density of the black monochromatic toner.

Next, in step S407, a toner patch pattern is formed on the intermediate transferring body 27.

The patch pattern is the same as that in the first embodiment. Namely, the patch pattern include a total of 16 patches of four yellow gradation patches, four magenta gradation patches, cyan gradation patches and black gradation patches. It is assumed herein that the formation conditions of the black toner patches are the same as those in the step S401. In addition, the formation conditions of the yellow, magenta and cyan patches are such that mixed color patches of yellow, magenta and cyan toners are formed eventually under the conditions in step S401, i.e., under which the densities and spectral characteristics of the yellow, magenta and cyan patches are equal to those of the black monochromatic toner.

In step S408, the densities of the toner patches formed in step S407 are detected by the density sensor 41.

In step S409, the output of the density sensor 41 is corrected. The correction method is the same as that in the first embodiment.

The density sensor 41 is thus corrected by the above-stated method in this embodiment.

It is noted that normal image density control is regularly executed by the density sensor 41 as in the case of the first embodiment.

In this embodiment, it is possible to provide a color image forming apparatus which can prevent the deterioration of the detection accuracy of the color sensor 42, i.e., the deterioration of the correction accuracy of the density sensor 41, which can suppress the consumption of the transferring material required for density control and which is superior in density stability to the conventional density control even if the light receiving characteristics of the color sensor 42 has large irregularities.

In this embodiment, if the color toners are detected by the color sensor, the toner mixed color proportion is adjusted until the output value of the black monochromatic toner is equal to that of mixed color toner and the detection is repeatedly executed. Alternatively, another method for calculating the toner mixed color proportion may be used. For example, a plurality of types of mixed color patches having toner mixed color proportions changed to a plurality of stages in advance may be formed, and a mixed color patch toner mixed proportion may be obtained so that the output values of the mixed color patches are equal to those of black patches, by a regression calculation from the output values of a plurality of mixed color patches. In any case, as long as mixed color patches are used if the color sensor detects the densities of color toners and the detected values of the mixed color patches are compared with the outputs of the black monochromatic patches, the method is not against the concept of the present invention.

The method in this embodiment is an optimum method for accurately correcting the density sensor even if the light receiving characteristics of the color sensor has large irregularities. If the light receiving characteristics of the color sensor has small irregularities, the spectral characteristics of the toners are almost equal to those of the filters of the color sensors, or if it is not required to correct the density sensor with a very high accuracy, then it is preferable to combine the third embodiment with the first embodiment in which the quantities of the transferring material and toners to be used are small and the control can be completed in a short period of time.

That is, an optimum method may be selected in accordance with the color image forming apparatus to which the present invention is applied.

Moreover, in this embodiment, only the example in which the density detection position of the density sensor is on the intermediate transferring body has been described. However, the density sensor installation position is not limited to that described in this embodiment. Specifically, the density sensor may be installed on the other image bearing member such as a photosensitive member, or a transferring material carrying member such as a transferring belt. In other words, the density sensor may be installed wherever an unfixed toner image can be formed.

As stated so far, it is possible to provide a color image forming apparatus which can suppress the consumption of the transferring material required for density control by correcting the density sensor using the color sensor, and which is superior in density stability to the conventional density control using only the density sensor.

The present invention has been described so far while referring to several preferred embodiments. However, it is obvious that the present invention is not limited to these embodiments and that various modifications and applications can be made to the present invention within the scope of claims which follow.

What is claimed is:

1. An image density control method for an image forming apparatus, said method comprising the steps of:

detecting, using a first density detector, a density of an unfixed toner image formed on an image bearing member or transferring material carrying member;

adjusting a gradation characteristic of the image forming apparatus based on a detection result obtained using the first density detector;

detecting, using a second density detector, a density of a fixed toner image formed on a transferring material; and correcting output of the first density detector based on a detection result obtained using the second density detector.

2. An image density control method according to claim 1, wherein said correcting step comprises a step of making a correction table for the first density detector.

3. An image density control method according to claim 2, wherein said correcting step comprises a step of making a correction table for the first density detector for achromatic toner based on a detection result obtained for a patch formed of the achromatic toner, using the second density detector, and making a correction table for the first density detector for chromatic toner based on a comparing result of detection results for (1) a color mixed patch formed of chromatic toner and (2) a patch formed of the achromatic toner.

4. An image density control method according to claim 1, wherein said correcting step comprises correcting output of the first density detector based on both a detection result obtained for a predetermined patch after fixing, obtained using the second density detector, and a detection result obtained for the predetermined patch before fixing, obtained using the first density.

5. An image density control method according to claim 1, wherein said correcting step comprises correcting output of the first density detector based on both a detection result obtained using the second density detector for a predetermined patch and a detection result obtained using the second detector, for the predetermined patch as fixed after being detected using the first density detector.

6. An image density control method according to claim 1, wherein the first density detector and the second density detector are arranged at the same position in a direction orthogonsl to a transferring material conveying direction.

7. An image density control method according to claim 1, wherein said adjusting step comprises a step of adjusting a development condition based on a detection result obtained using the first density detector.

8. An image density control method according to claim 1, wherein the image forming apparatus comprises:

an image forming unit adapted to form an image on a photoreceptor;

a first transferring unit adapted to transfer the image formed on a photoreceptor to an intermediate transferring medium; and a second transferring unit adapted to transfer the image on the intermediate transferring medium to a transferring material.

9. An image density control method according to claim 8, wherein the first density detector detects the patch on the intermediate transferring medium, and the second density detector detects the patch on the transferring material.

10. An image density control method according to claim 1, wherein the second density detector is outside of the image forming apparatus.

11. An image density control method for an image forming apparatus, said method comprising the steps of:

detecting, using a first density detector, a density of an unfixed toner image formed on an image bearing member or transferring material carrying member;

detecting, using a second density detector, a density of a fixed toner image formed on a transferring material; and determining a failure of the first density detector or of the second density detector based on both a detection result obtained using the first density detector for a predetermined patch and a detection result obtained using the second detector for the predetermined patch after being detected by the first density detector and fixed.

12. An image density control method according to claim 11, wherein the first density detector and the second density detector are arranged at the same position in a direction orthogonal to a transferring material conveying direction.

13. An image forming apparatus comprising:

a first density detector adapted to detect a density of an unfixed toner image formed on an image bearing member or transferring material carrying member;

a first controller adapted to adjust a gradation characteristic of said image forming apparatus based on a detection result obtained using said first density detector;

a second density detector adapted to detect a density of a fixed toner image formed on a transferring material; and a second controller adapted to correct output of said first density detector based on a detection result obtained using said second density detector.

14. An image forming apparatus comprising:

a first density detector adapted to detect a density of an unfixed toner image formed on an image bearing member or transferring material carrying member;

a second density detector adapted to detect a density of a fixed toner image formed on a transferring material; and a determining unit adapted to determine a failure of said first density detector or of said second density detector based on both a detection result obtained using said first density detector for a predetermined patch and a detection result obtained using said second detector for the predetermined patch after being detected by said first density detector and fixed.

* * * * *

UNITED STATES PATENT AND TRADEMARK OFFICE

CERTIFICATE OF CORRECTION

PATENT NO. : 6,898,381 B2
DATED : May 24, 2005
INVENTOR(S) : Yoichiro Maebashi et al.

It is certified that error appears in the above-identified patent and that said Letters Patent is hereby corrected as shown below:

Column 4,
Line 46, “rotate” should read -- rotates --.

Column 5,
Line 15, “printing” should read -- the printing --.

Column 8,
Line 33, “whenever, the” should read -- whenever the --.

Column 13,
Line 10, “difference,” should read -- differences, --.

Column 16,
Line 12, “orthogonsl” should read -- orthogonal --.

Signed and Sealed this

Twenty-second Day of November, 2005

JON W. DUDAS
*Director of the United States Patent and Trademark Office*